US008957927B2

(12) United States Patent
Qiu

(10) Patent No.: US 8,957,927 B2
(45) Date of Patent: Feb. 17, 2015

(54) DISPLAY DEVICE HAVING AN INTERFACE BOARD FOR OUTPUTTING A PLURALITY GROUPS OF PANEL DRIVING DATA AND DRIVING METHOD THEREOF

(75) Inventor: Jun-Xin Qiu, New Taipei (TW)

(73) Assignee: Wistron Corp., New Taipei (TW)

( * ) Notice: Subject to any disclaimer, the term of this patent is extended or adjusted under 35 U.S.C. 154(b) by 309 days.

(21) Appl. No.: 13/411,249

(22) Filed: Mar. 2, 2012

(65) Prior Publication Data

US 2013/0088525 A1 Apr. 11, 2013

(30) Foreign Application Priority Data

Oct. 8, 2011 (CN) ..... 2011 1 0303008

(51) Int. Cl.
*G09G 5/02* (2006.01)
*G09G 3/20* (2006.01)
*G09G 3/34* (2006.01)

(52) U.S. Cl.
CPC ... *G09G 3/20* (2013.01); *G09G 3/34* (2013.01)
USPC ..... 345/699; 345/3.4

(58) Field of Classification Search
CPC ..... G09G 5/006
USPC ..... 345/699, 3.4
See application file for complete search history.

(56) References Cited

U.S. PATENT DOCUMENTS

| | | | | |
|---|---|---|---|---|
| 6,606,088 | B1 | 8/2003 | Yang et al. | |
| 7,880,707 | B2 | 2/2011 | Yang et al. | |
| 2002/0188770 | A1* | 12/2002 | Kehlet | 710/8 |
| 2004/0036697 | A1 | 2/2004 | Kim et al. | |
| 2005/0225547 | A1* | 10/2005 | Choi | 345/211 |
| 2005/0285832 | A1* | 12/2005 | Shin et al. | 345/87 |
| 2006/0092187 | A1* | 5/2006 | Wang | 345/698 |
| 2007/0216669 | A1 | 9/2007 | Narui et al. | |

FOREIGN PATENT DOCUMENTS

| | | |
|---|---|---|
| TW | 594125 | 6/2004 |
| TW | 201120841 | 6/2011 |

* cited by examiner

*Primary Examiner* — Long D Pham
(74) *Attorney, Agent, or Firm* — Gable Gotwats

(57) ABSTRACT

A display device is provided. The display device includes an interface board, a display panel and a connecting interface. The interface board includes a system control module and a system storage module for storing a plurality groups of panel driving data. The display panel includes a pixel array, a signal receiver and a panel data storage module for storing panel data. The connecting interface connects the interface board and the display panel and generates an intimating signal and transmits the same when these elements are electrically connected. The system control module retrieves panel data from the panel data storage module through the connecting interface to further retrieve one of the groups of panel driving data to output the same. The signal receiver drives the pixel array according to the one of the groups of panel driving data. A display device drive method is also disclosed.

13 Claims, 3 Drawing Sheets

DISPLAY DEVICE HAVING AN INTERFACE BOARD FOR OUTPUTTING A PLURALITY GROUPS OF PANEL DRIVING DATA AND DRIVING METHOD THEREOF

RELATED APPLICATIONS

This application claims priority to Chinese Patent Application Serial Number 201110303008.1, filed Oct. 08, 2011, which is herein incorporated by reference.

BACKGROUND

1. Technical Field

The present disclosure relates to display technology. More particularly, the present disclosure relates to a display device and a drive method to drive the display device.

2. Description of Related Art

A display device is an essential part of an electronic system. A common display device has two main parts, and these include an interface board and a display panel. The interface board and the display panel are connected through a connecting interface. Accordingly, the interface board is able to provide an image signal to the display panel through the connecting interface such that the display panel can display an image corresponding to the image signal. However, there are various kinds of specifications among the different display panels. For example, resolution, backlight module driving voltage and backlight module driving current are specifications for a display panel that may vary depending on the manufacturer.

In order to meet the different specification requirements of different display panels, different hardware and firmware of the interface board need to be designed. One consequence of this is that manufacturing costs cannot be lowered due to such different designs that are required.

SUMMARY

An aspect of the present disclosure is to provide a display device. The display device includes an interface board, a display panel and a connecting interface. The interface board includes a system control module and a system storage module coupled to the system control module for storing a plurality of groups of panel driving data. The display panel includes a pixel array, a signal receiver and a panel data storage module for storing panel data. The connecting interface connects the interface board and the display panel, and generates an intimating signal and transmits the intimating signal to the interface board when the display panel and the interface board are electrically connected. In response to receiving the intimating signal from the connection interface, the system control module of the interface board retrieves the panel data from the panel data storage module through the connecting interface and further retrieves one of the groups of the panel driving data from the system storage module according to the retrieved panel data, the system control module outputting the one of the groups of the panel driving data to the signal receiver to drive the pixel array according to the one of the groups of the panel driving data. The one of the groups of the panel driving data comprises at least one panel driving parameter for driving the pixel array.

Another aspect of the present disclosure is to provide a drive method used in a display device. The drive method includes determining whether a connecting interface between a display panel and an interface board of the display device has generated an intimating signal and has transmitted the intimating signal to the interface board so as to determine that the display panel and the interface board are electrically connected. The method further includes, in response to determining that the intimating signal has been generated and transmitted to the interface board, retrieving a panel data stored in a panel data storage module of the display panel through the connecting interface by a system control module of the interface board, and further retrieving one of the groups of the panel driving data from a system storage module of the interface board according to the retrieved panel data by the system control module of the interface board. The one of the groups of the panel data driving data is output to a signal receiver of the display device by the system control module. Moreover, a pixel array of the display panel is driven according to the one of the groups of the panel driving data by the signal receiver. The one of the groups of the panel driving data comprises at least one panel driving parameter for driving the pixel array.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
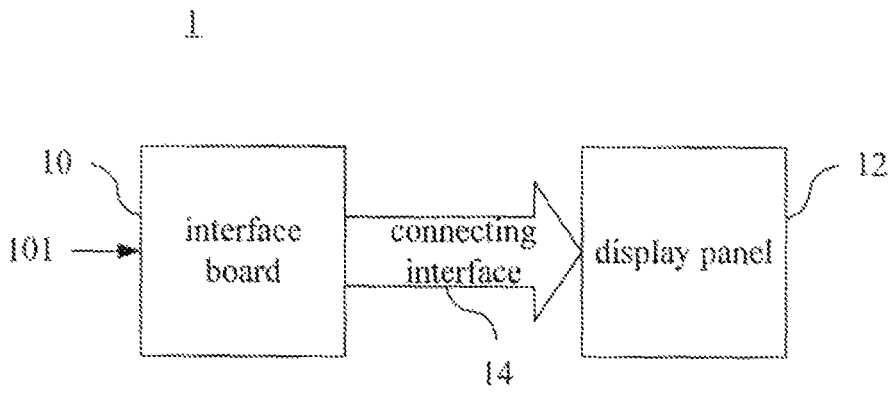
FIG. 1 is a block diagram of a display device of an embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

FIG. 1 is a block diagram of a display device 1 of an embodiment of the present disclosure. The display device 1 includes an interface board 10, a display panel 12 and a connecting interface 14.

The connecting interface 14 connects the interface board 10 and the display panel 12. The interface board 10 receives an image input signal 101 from a processor of a host (not shown) to process the image input signal 101 and further transmits the image input signal 101 (after processing) to the display panel 12 for display of an image corresponding to the image input signal 101. Further, the interface board 10 provides various kinds of voltages, currents and timing signals to the display panel 12 such that the display panel 12 can operate to display the image.

Figure 2:
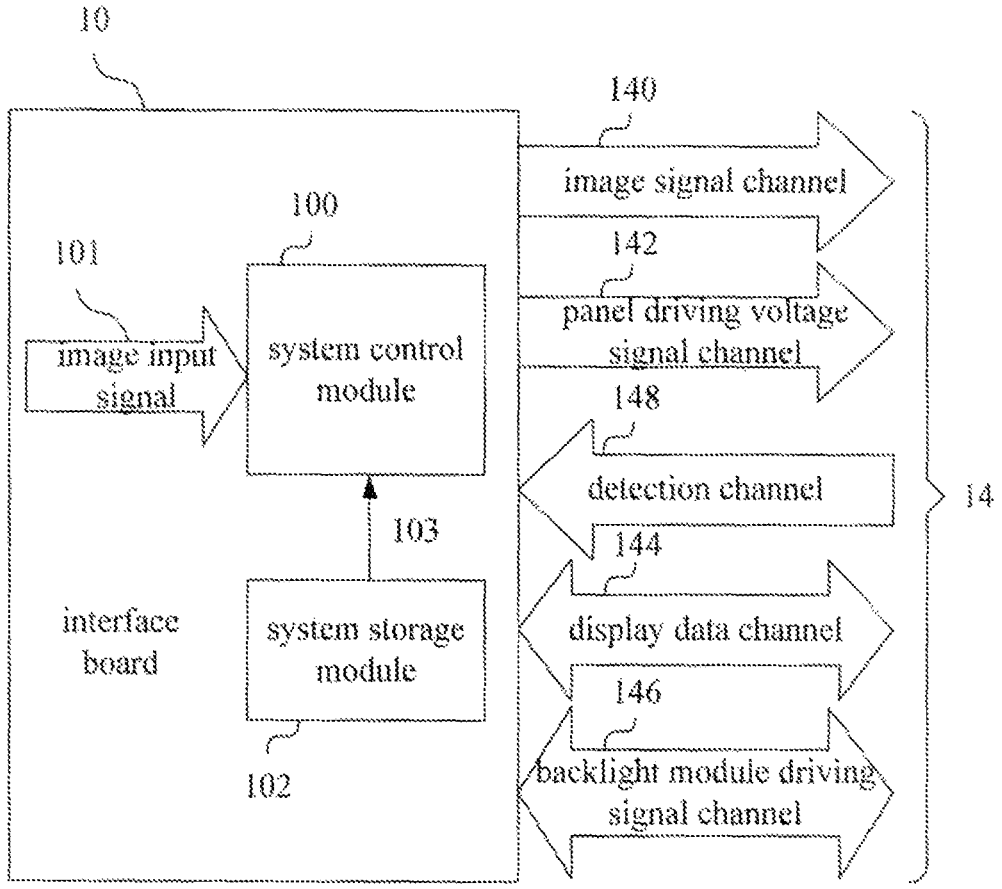
FIG. 2 is a detailed block diagram of an interface board and a connecting interface in an embodiment of the present disclosure.

FIG. 2 is a detailed block diagram of the interface board 10 and the connecting interface 14 in an embodiment of the present disclosure. The interface board 10 includes a system control module 100 and a system storage module 102. In an embodiment, the system control module 100 is a scaler to adjust the resolution and the size of the image input signal 101. After the adjustment, the system control module 100 outputs an image signal that can be displayed by the display panel 12. In other embodiments, the system control module 100 may comprise other signal processing modules. For example, the system control module 100 may includes an analog/digital converter (ADC) or decoder (not shown) to perform analog-to-digital conversion or a decoding process. The image input signal 101 can be in various formats, such as digital video interface (DVI), video graphic array (VGA), high-definition multimedia interface (HDMI), displayport (DP) or other kinds of formats. The system storage module 102 stores a plurality of groups of panel driving data 103. Details of the panel driving data 103 will be discussed below.

The connecting interface 14 includes different panels or pins. In an embodiment, the connecting interface 14 includes an image signal channel 140, a panel driving voltage (Vcc) signal channel 142, a backlight module driving signal channel 146 and a display data channel 144. The display data channel 144 is used for transmitting panel data. A backlight module driving signal is transmitted through the backlight module driving signal channel 146. The backlight module driving signal includes a backlight module driving voltage and a backlight module driving current. In the present embodiment, the connecting interface 14 further includes a detection channel 148 to detect the connection state between the display panel 12 and the interface board 10. The detection channel 148 further transmits an intimating signal when the display panel 12 and the interface board 10 are electrically connected. In an embodiment, when the display panel 12 and the interface board 10 are not electrically connected, the detection channel 148 maintains a high level state or a high impedance state. When the display panel 12 and the interface board 10 are electrically connected, the detection channel 148 turns to a low level state from the high level state or the high impedance state such that the system control module 100 of the interface board 10 detects the electrical connection of the display panel 12 and the interface board 10 through the change of the voltage level of the detection channel 148. Hence, a connection alert mechanism can be accomplished through the change of the voltage level.

Figure 3:
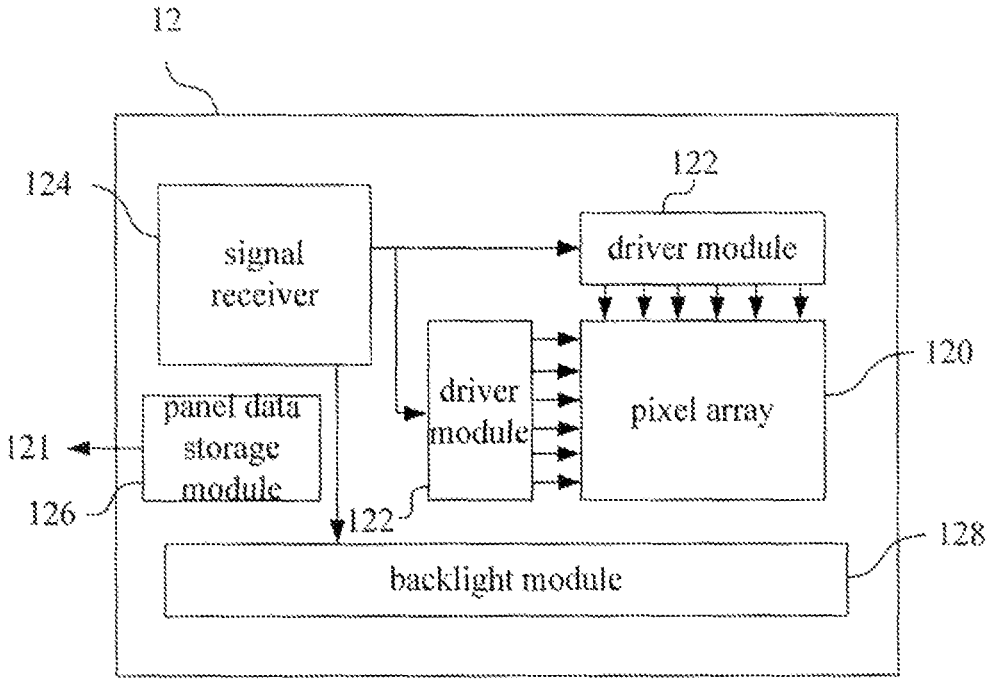
FIG. 3 is a detailed block diagram of a display panel in an embodiment of the present disclosure.

FIG. 3 is a detailed block diagram of the display panel 12 in an embodiment of the present disclosure. The display panel 12 includes a pixel array 120, a driver module 122, a signal receiver 124, a panel data storage module 126 and a backlight module 128. When the system control module 100 of the interface board 10 receives the intimating signal from the detection channel 148, it retrieves panel data 121 from the panel data storage module 126 through the connecting interface 14. In an embodiment, the system control module 100 retrieves the panel data 121 from the panel data storage module 126 through the display data channel 144 of the connecting interface 14.

In an embodiment, the panel data 121 is an extended display identification data (EDID) having the identification code of the manufacturer of the display panel 12 and basic display parameters such as the resolution and the color depth of the display panel 12. In other embodiments, the panel data 121 may comprise other information to identify the type of the display panel 12. The panel data 121 can also be stored in the panel data storage module 126 by using other formats different from EDID. After the system control module 100 retrieves the panel data 121, it determines the type of the display panel 12 and retrieves one group of panel driving data 103 from the system storage module 102 of the interface board 10.

The panel driving data 103 includes at least one panel driving parameter for driving the display panel 12. In an embodiment, there are many panel driving parameters, and these comprise the driving voltage that the driver module 122 needs to drive the pixel array 120, the size and the resolution of the pixel array 120, the timing parameters of the display panel 12, the driving current/voltage to drive the backlight module 128, etc. The system control module 100 of the interface board 10 outputs the panel driving parameters to the signal receiver 124 of the display panel 12 through the panel driving voltage (Vcc) signal channel 142, the backlight module driving signal channel 146 and the display data channel 144 of the connecting interface 14.

In an embodiment, the panel driving data 103 may include a group of default panel driving data. When none of the groups of the panel driving data 103 corresponding to the display panel 12 is retrieved according to the panel data 121, the system control module 100 simply retrieves the default panel driving data and generates at least one default panel driving parameter. For example, when the system control module 100 is not able to identify the manufacturer of the display panel 12, is not able to identify the format of the panel data 121 or is not able to determine whether the display panel 12 and the interface board 10 are electrically connected by using the detection channel 148, the system control module 100 can retrieve the default panel driving data and output the default panel driving parameter.

In an embodiment, the driving voltage that the driver module 122 needs to drive the pixel array 120 is transmitted through the panel driving voltage (Vcc) signal channel 142. The size, the resolution and the timing parameters of the display panel 12 are transmitted through the display data channel 144. The driving current and the driving voltage to drive the backlight module 128 are transmitted through the backlight module driving signal channel 146. It is noted that the parameters mentioned in the above embodiment is merely an example. In other embodiments, other parameters can be used as well.

The signal receiver 124 of the display panel 12 drives the pixel array 120 and the backlight module 128 according to the image signal and the panel driving parameters. In an embodiment, the system control module 100 adjusts the image input signal 101 according to the panel driving parameters to further output the image signal to the signal receiver 124. For example, the driving voltage that the driver module 122 needs to drive the pixel array 120 can be 5V. The size and the resolution of the display panel 12 can be 1280×1024, 1920×1080 or 1920×1200. The driving current and the driving voltage to drive the backlight module 128 can be 120 mA/38.5V or 65 ma/47.6V when a 23-inch display panel is used. In other embodiments, the number of the parameters can be modified according to different applications.

In an embodiment, the signal receiver 124 includes a timing controller and other modules to control the driver module 122 to drive the pixel array 120. In an embodiment, the driver module 122 comprises a source driver and a gate driver (not shown) to drive the pixels (not shown) on the pixel array 120. The signal receiver 124 further generates the driving current and the driving voltage for driving the backlight module 128 such that the backlight module 128 emits light according to the backlight module driving voltage and the backlight module driving current. Hence, the pixel array 120 displays an image according to driving voltage, size, resolution and the light emitted from the backlight module 128.

Figure 4:
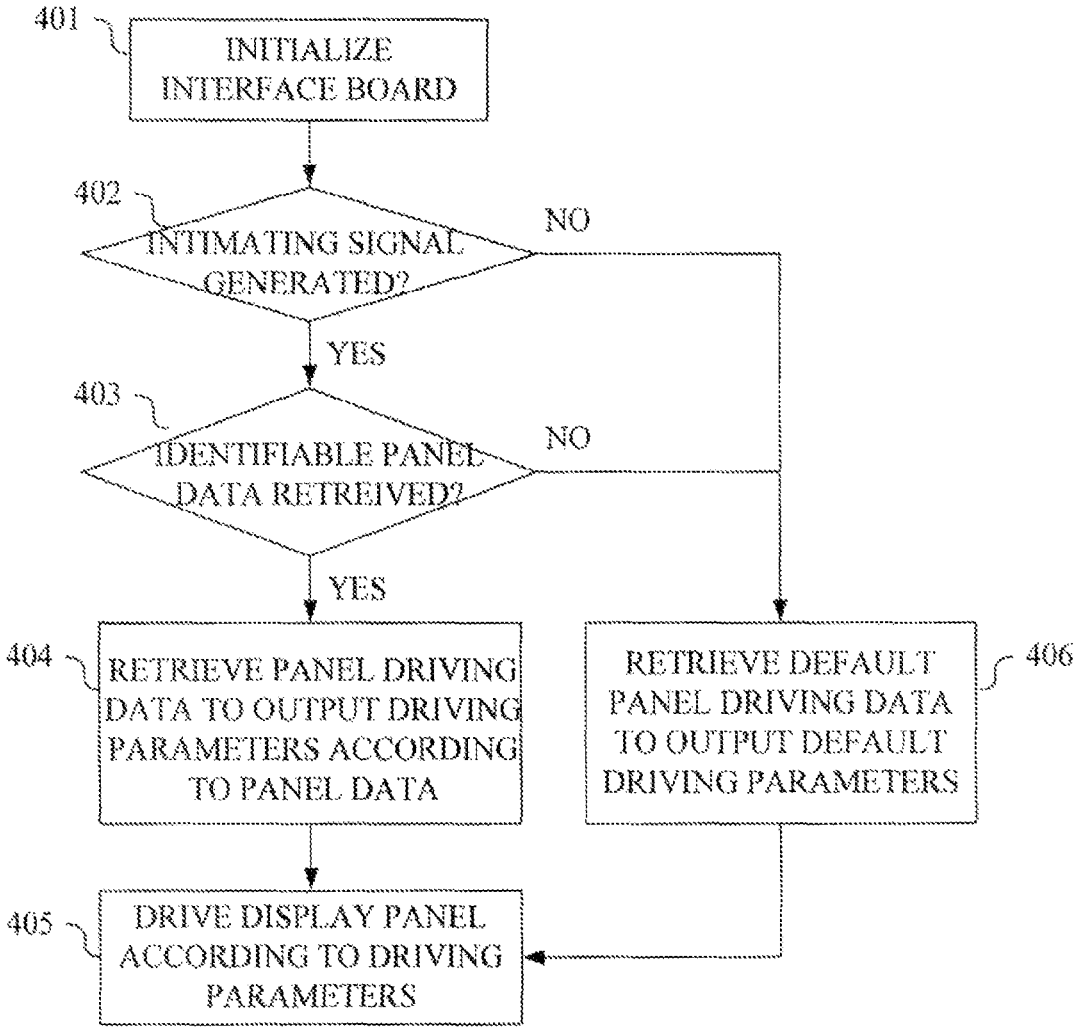
FIG. 4 is a flow chart of a drive method of an embodiment of the present disclosure.

FIG. 4 is a flow chart of a drive method 400 of an embodiment of the present disclosure. The drive method 400 can be used in the display device depicted in FIG. 1. The drive method 400 includes the steps outlined below.

In step 401, the interface board 10 is initialized.

In step 402, the system control module 100 of the interface board 10 determines whether the connecting interface 14 has generated an intimating signal and transmitted the same to the interface board 10, so that the system control module 100 can determine whether the interface board 10 and the display panel 12 are electrically connected. In an embodiment, the intimating signal is generated by changing the voltage level of the detection channel 148 of the connecting interface 14 when the interface board 10 and the display panel 12 are electrically connected.

In step 403, the system control module 100 determines whether an identifiable panel data 121 is retrieved from the panel data storage module 126 of the display panel 12 through the connecting interface 14 when the intimating signal is generated. In an embodiment, the system control module 100 retrieves the panel data 121 through the display data channel 144 of the connecting interface 14.

In step 404, the system control module 100 retrieves a group of panel driving data 103 according to the panel data 121 when the panel data 121 is identifiable, and further outputs corresponding panel driving parameters to the signal driver 124 of the display panel 12.

In step 405, the signal receiver 124 drives the pixel array 120 of the display panel 12 according to the panel driving parameters.

When the system control module 100 determines that the connecting interface 14 has not generated an intimating signal in step 402 or when the system control module 100 does not retrieve an identifiable panel data 121, a group of default panel driving data is retrieved in step 406, and default panel driving parameters are output to the signal driver 124. After step 406, step 405 is performed such that he signal driver 124 drives the pixel array 120 of the display panel 12 according to the default panel driving parameters.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A display device, comprising:

an interface board, comprising:

a system control module; and a system storage module coupled to the system control module for storing a plurality groups of panel driving data;

a display panel, comprising:

a pixel array;

a signal receiver; and a panel data storage module for storing panel data; and a connecting interface for connecting the interface board and the display panel and for generating an intimating signal and transmitting the intimating signal to the interface board when the display panel and the interface board are electrically connected;

wherein, in response to receiving the intimating signal from the connecting interface, the system control module of the interface board retrieves the panel data from the panel data storage module through the connecting interface and further retrieves one of the groups of the panel driving data from the system storage module according to the retrieved panel data, the system control module outputting the one of the groups of the panel driving data to the signal receiver to drive the pixel array according to the one of the groups of the panel driving data, the one of the groups of the panel driving data comprising at least one panel driving parameter for driving the pixel array, and wherein when the connecting interface does not generate the intimating signal, the system control module outputs at least one default panel driving parameter, instead of the one of the groups of the panel driving data, to the signal receiver of the display panel according to the panel data and a group of default panel driving data of the system storage module of the interface board.

2. The display device of claim 1, wherein the system control module further receives an image input signal and adjusts the image input signal according to the one of the groups of the panel driving data to further output an image signal to the signal receiver.

3. The display device of claim 2, wherein the display panel further comprises a driver module, and the signal receiver controls the driver module to drive the pixel array to display an image according to the panel driving parameter and the image signal.

4. The display device of claim 1, wherein the display panel further comprises a backlight module, and the signal receiver controls a backlight module driving voltage and a backlight module driving current according to the panel driving parameter such that the backlight module emits light according to the backlight module driving voltage and the backlight module driving current.

5. The display device of claim 1, wherein the panel driving data comprises a backlight module driving voltage, a backlight module driving current, a panel driving voltage, a timing parameter and a display resolution.

6. The display device of claim 1, wherein the connecting interface comprises a detection channel, a voltage level of the detection channel being changed to generate the intimating signal when the display panel and the interface board are electrically connected.

7. The display device of claim 1, wherein the connecting interface comprises a display data channel (DDC) and the system control module of the interface board retrieves the panel data from the panel data storage module of the display panel through the display data channel of the connecting interface.

8. A drive method used in a display device, wherein the drive method comprises:

determining whether a connecting interface between a display panel and an interface board of the display device has generated an intimating signal and has transmitted the intimating signal to the interface board so as to determine that the display panel and the interface board are electrically connected;

in response to determining that the intimating signal has been generated and transmitted to the interface board, retrieving a panel data stored in a panel data storage module of the display panel through the connecting interface by a system control module of the interface board, and further retrieving one of the groups of the panel driving data from a system storage module of the interface board according to the retrieved panel data by the system control module of the interface board;

outputting the one of the groups of the panel data driving data to a signal receiver of the display device by the system control module; and driving a pixel array of the display panel according to the one of the groups of the panel driving data by the signal receiver;

wherein the one of the groups of the panel driving data comprises at least one panel driving parameter for driving the pixel array, wherein when the connecting interface does not generate the intimating signal, the system control module outputs at least one default panel driving parameter, instead of the one of the groups of the panel driving data, to the signal receiver of the display device according to the panel data and a group of default panel driving data of the system storage module of the interface board.

9. The drive method of claim 8, further comprising:

receiving an image input signal, and adjusting the image input signal by the system control module according to the one of the groups of the panel driving data to thereby obtain an image signal;

outputting the image signal to the signal receiver by the system control module; and controlling a driver module of the display panel by the signal receiver to drive the pixel array to display an image according to the panel driving parameter and the image signal.

10. The drive method of claim 8, further comprising controlling a backlight module driving voltage and a backlight module driving current by the signal receiver according to the panel driving parameter such that a backlight module emits light according to the backlight module driving voltage and the backlight module driving current.

11. The drive method of claim 8, wherein the panel driving data comprises a backlight module driving voltage, a backlight module driving current, a panel driving voltage, a timing parameter and a display resolution.

12. The drive method of claim 8, wherein the connecting interface comprises a detection channel, a voltage level of the detection channel being changed to generate the intimating signal when the display panel and the interface board are electrically connected.

13. The drive method of claim 8, further comprising outputting at least one default panel driving parameter, instead of the one of the groups of the panel driving data, to the signal receiver of the display device by the system control module according to the panel data and a group of default panel driving data of the system storage module of the interface board when none of the groups of the panel driving data corresponds to the display panel.

* * * * *